US009570062B2

(12) United States Patent
Wu et al.

(10) Patent No.: US 9,570,062 B2
(45) Date of Patent: Feb. 14, 2017

(54) METHOD AND DEVICE FOR SELF-ADAPTIVELY ELIMINATING NOISES

(71) Applicant: GOERTEK INC, Weifang (CN)

(72) Inventors: Fengliang Wu, Weifang (CN); Zhenhua Zhi, Weifang (CN)

(73) Assignee: GOERTEK INC, Weifang (CN)

( * ) Notice: Subject to any disclaimer, the term of this patent is extended or adjusted under 35 U.S.C. 154(b) by 108 days.

(21) Appl. No.: 14/412,080

(22) PCT Filed: Sep. 2, 2013

(86) PCT No.: PCT/CN2013/082791

§ 371 (c)(1),
(2) Date: Dec. 30, 2014

(87) PCT Pub. No.: WO2014/036918

PCT Pub. Date: Mar. 13, 2014

(65) Prior Publication Data

US 2015/0179160 A1 Jun. 25, 2015

(30) Foreign Application Priority Data

Sep. 7, 2012 (CN) ..... 2012 1 0330475

(51) Int. Cl.
*H04R 3/00* (2006.01)
*G10K 11/175* (2006.01)
(Continued)

(52) U.S. Cl.
CPC ..... *G10K 11/175* (2013.01); *G10L 21/0208* (2013.01); *H04R 3/005* (2013.01); *G10L 2021/02165* (2013.01); *H04R 2410/05* (2013.01)

(58) Field of Classification Search
CPC ..... H04R 3/005; H04R 1/406; H04R 25/40; H04R 25/407; G10L 2021/02165; G10L 2021/02168; G10L 2021/0208; G10L 21/028
(Continued)

(56) References Cited

U.S. PATENT DOCUMENTS 7,206,418 B2 * 4/2007 Yang ..... H04R 3/005 381/92
7,660,425 B1 2/2010 Reed et al.
(Continued)

FOREIGN PATENT DOCUMENTS

CN 101192411 6/2008
CN 101779476 7/2010
(Continued)

*Primary Examiner* — Duc Nguyen
*Assistant Examiner* — Kile Blair
(74) *Attorney, Agent, or Firm* — Harness, Dickey & Pierce, P.L.C.

(57) ABSTRACT

The present invention discloses a method and device for self-adaptively eliminating noises. Said method comprises: filtering the signal received by a first microphone using a first filter, filtering the signal received by a second microphone using a second filter, and obtaining a signal with noises reduced by subtracting the filtered signals; wherein, in a noise segment, the coefficients of the first filter the second filter are updated respectively using the signal with noises reduced such that the noise component contained in the signal filtered by the first filter tends to be the same with the noise component contained in the signal filtered by the second filter; and in a noisy voice segment, the coefficients of the first filter and the second filter are remained unchanged respectively, the first filter and the second filter respectively use a coefficient updated in the noise segment last time to filter the signals received by the first microphone and the second microphone. The present invention can
(Continued)

address the problem that noise eliminating effect is poor in the prior art caused by the fact that FIR filter cannot approach the optimal solution for eliminating noises.

8 Claims, 6 Drawing Sheets

(51) Int. Cl.
*G10L 21/0208* (2013.01)
*G10L 21/0216* (2013.01)

(58) Field of Classification Search
USPC ..... 381/92
See application file for complete search history.

(56) References Cited

U.S. PATENT DOCUMENTS

| | | | |
|---|---|---|---|
| 7,783,032 | B2 | 8/2010 | Abutalebi et al. |
| 8,238,575 | B2 | 8/2012 | Buck et al. |

FOREIGN PATENT DOCUMENTS

| | | |
|---|---|---|
| CN | 102543060 | 7/2012 |
| CN | 102629472 | 8/2012 |
| CN | 102820036 | 12/2012 |
| CN | 202838949 | 3/2013 |

* cited by examiner

METHOD AND DEVICE FOR SELF-ADAPTIVELY ELIMINATING NOISES

TECHNICAL FIELD

The present invention relates to the field of signal processing, particularly to a method and device for self-adaptively eliminating noises.

BACKGROUND ART

LMS (Least Mean Square) algorithm in the prior art adopts a single-filter structure as shown in FIG. 1. As shown in FIG. 2, its principle is that a signal received from one of the microphones is filtered, and the filtered signal is subtracted by a signal received from the other microphone to obtain a voice with noises reduced. The filter of the single-filter structure is merely updated in noise segments but remains unchanged in noisy voice segments.

If standard time domain LMS algorithm is used to compute convolutional non-additivity interference noises, the computation will be relatively complicated. In order to reduce the computational complexity, Ferrara proposed FBLMS (Fast Block LMS) algorithm, using a method of combining time and frequency domains, i.e., converting the original convolution operation in a time domain into a product operation in a frequency domain, which greatly reduces the computational complexity.

Hereinafter, the defects in LMS algorithm of the single-filter structure in the prior art will be described.

The defects in the single-filter structure will be expounded by analyzing the theoretical optimal solution of the filter in the single-filter structure. The analysis and calculation of the theoretical optimal solution of a filter is conducted in a frequency domain since the optimal solution of the filter can be clearly analyzed in a frequency domain.

FIG. 3 shows the analysis of the optimal solution of a filter frequency domain in a single-filter structure. In FIG. 3, S1 represents a signal source and S2 represents a noise source. Since FIR (Finite Impulse Response) filter can indicate more accurately the transfer function from a signal source to microphones, in the analysis, FIR filters are used to simulate the channel transfer function H11 between a signal source and a first microphone, the channel transfer function H12 between a noise source and the first microphone, the channel transfer function H21 between the signal source and a second microphone, and the channel transfer function H22 between the noise source and the second microphone, respectively. The signal received by the first microphone is X1, and the signal received by the second microphone is X2, W is a filter, and Y1 is a signal with noises reduced.

The following equations can be obtained:

$$X1 = S1 \times H11 + S2 \times H12 \quad \text{Equation 1}$$

$$X2 = S1 \times H21 + S2 \times H22 \quad \text{Equation 2}$$

$$\begin{aligned} Y1 &= X1 - X2 \times W \\ &= (S1 \times H11 + S2 \times H12) - (S1 \times H21 + S2 \times H22) \times W \\ &= S1 \times (H11 - H21 \times W) + S2 \times (H12 - H22 \times W) \end{aligned} \quad \text{Equation 3}$$

Since noise source S2 will be completely eliminated when W is taken as the optimal solution, it can be inferred that the optimal solution of W is as shown in Equation 4:

$$H12 - H22 \times W = 0 \Rightarrow W = H12/H22 \quad \text{Equation 4}$$

$$Y1 = S1 \times (H11 - H21 \times W) = S1 \times (H11 - H21 \times H12/H22) \quad \text{Equation 5}$$

From Equation 5, it can be known that Y1 is a form of S1 that has been filtered in a certain mode and does not contain any component of S2.

From the above-obtained optimal solution as W=H12/H22, it can be seen that the optimal solution of W is not a FIR filter. Nevertheless, in practice, in order to ensure the stability and easy realization of a filter, a FIR filter is usually used, though it may introduce a great error because a non-FIR filter cannot be well approached by a FIR filter.

In a standard single-filter structure LMS algorithm, the optimal solution of a filter is a non-FIR filter. However, in practical application, the filter in this structure usually uses a FIR filter to approach this optimal solution, which may introduce a great error and cause poor noise elimination effect.

SUMMARY OF THE INVENTION

The present invention provides a method and device for self-adaptively eliminating noises to address the problem that noise eliminating effect is poor in the prior art caused by the fact that FIR filter cannot approach the optimal solution for eliminating noises.

The present invention discloses a method for self-adaptively eliminating noises, said method comprising:

filtering the signal received by a first microphone using a first filter, filtering the signal received by a second microphone using a second filter, and obtaining a signal with noises reduced by subtracting the filtered signals;

wherein, in a noise segment, the coefficient of the first filter and the coefficient of the second filter are updated respectively using the signal with noises reduced in the following manner: the ratio of the transfer function of the first filter to the transfer function of the second filter approaches the ratio of the channel transfer function between a noise source and the second microphone to the channel transfer function between the noise source and the first microphone; and in a noisy voice segment, the coefficient of the first filter and the coefficient of the second filter are remained unchanged respectively, the first filter uses a coefficient updated in the noise segment last time to filter the signal received by the first microphone, and the second filter uses a coefficient updated in the noise segment last time to filter the signal received by the second microphone;

wherein, approaching the ratio of the transfer function of the first filter to the transfer function of the second filter to the ratio of the channel transfer function between the noise source and the second microphone to the channel transfer function between the noise source and the first microphone specifically comprises:

approaching the transfer function of the first filter to the channel transfer function between the noise source and the second microphone, and approaching the transfer function of the second filter to the channel transfer function between the noise source and the first microphone;

or, approaching the transfer function of the first filter to the product of the channel transfer function between the noise source and the second microphone and a constant, and approaching the transfer function of the second filter to the product of the channel transfer function between the noise source and the first microphone and the constant;

wherein, updating the coefficient of the first filter and the coefficient of the second filter respectively using the signal with noises reduced specifically comprises:

updating the coefficient of the first filter and the coefficient of the second filter respectively using the signal with noises reduced by means of least mean square algorithm or fast block least mean square algorithm.

The present invention further discloses a device for self-adaptively eliminating noises, said device comprising: a first microphone, a second microphone, a first filter, a second filter, and a subtracter;

the first microphone inputting the received signal to the first filter, the first filter inputting the filtered signal to the subtracter;

the second microphone inputting the received signal to the second filter, the second filter inputting the filtered signal to the subtracter;

the subtracter subtracting the signals filtered by the first filter and the second filter to obtain a signal with noises reduced;

wherein, in a noise segment, the coefficient of the first filter and the coefficient of the second filter are updated respectively based on the signal with noises reduced in the following manner: the ratio of the transfer function of the first filter to the transfer function of the second filter approaches the ratio of the channel transfer function between a noise source and the second microphone to the channel transfer function between the noise source and the first microphone; and in a noisy voice segment, the coefficient of the first filter and the coefficient of the second filter are remained unchanged respectively, the coefficient used by the first filter for filtering the signal received by the first microphone is a coefficient updated in the noise segment last time, and the coefficient used by the second filter for filtering the signal received by the second microphone is a coefficient updated in the noise segment last time.

The advantages of the present invention are: in a noise segment, updating the coefficients of the first and second filters respectively using the signal with noises reduced allows the noise component contained in the signal filtered by the first filter to tend to be the same with the noise component contained in the signal filtered by the second filter; and in a noisy voice segment, by means of remaining the coefficient of the first filter and the coefficient of the second filter unchanged, and filtering, by the first filter and the second filter, the signals received by the first microphone and the second microphone respectively using the coefficients updated in the noise segment last time, the noise components in the signal will offset each other when subtracting the signals filtered by the two filters, thereby enhancing the noise elimination effect.

DETAILED DESCRIPTION OF EMBODIMENTS

To make the object, technical solution and advantages of the present invention clearer, the embodiments of the present invention are described in further detail with reference to drawings.

Embodiment 1

Figure 1:
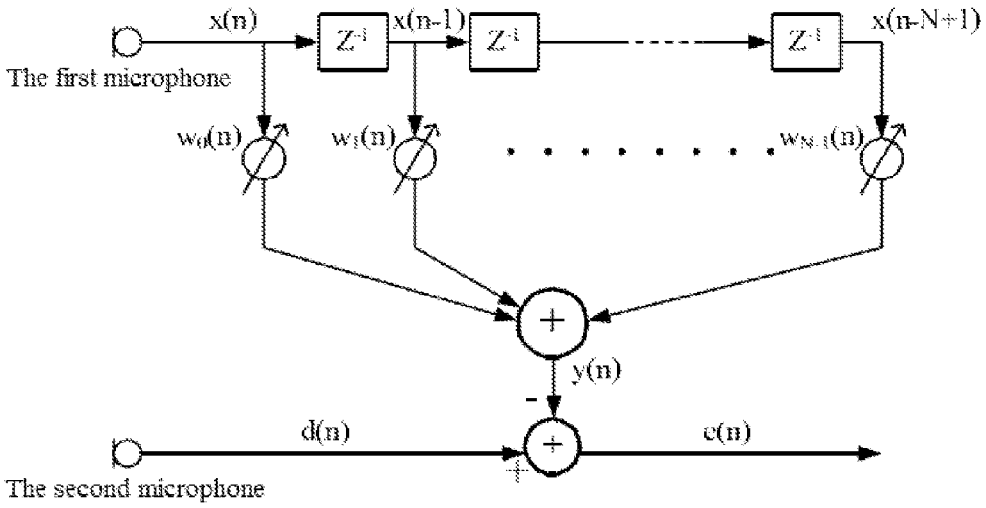
FIG. 1 is a schematic diagram of a method for eliminating noises using a single filter in LMS of the prior art.
Figure 2:
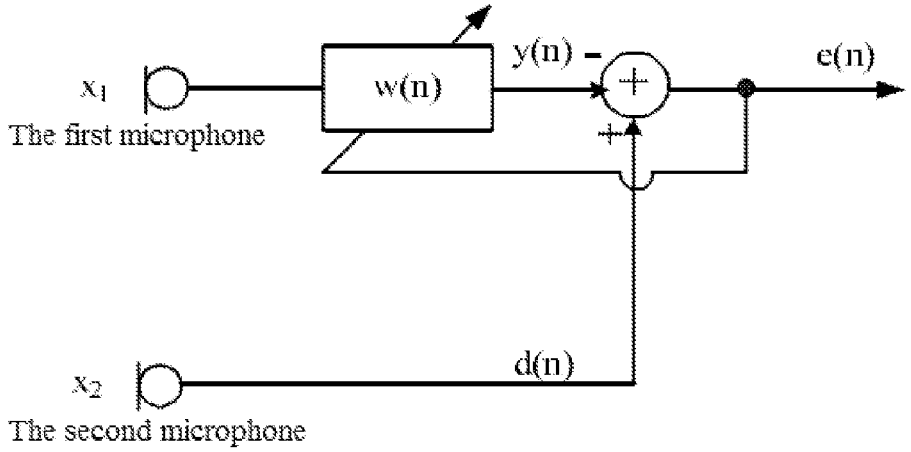
FIG. 2 is a principle diagram of a method for eliminating noises using a single filter in LMS of the prior art.
Figure 3:
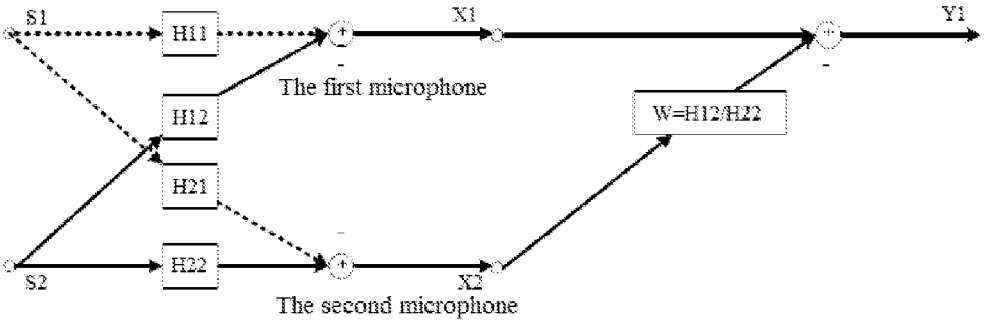
FIG. 3 is a schematic diagram analyzing the principle of the optimal solution in a frequency domain when using a single filter to eliminate noises in LMS of the prior art.
Figure 4:
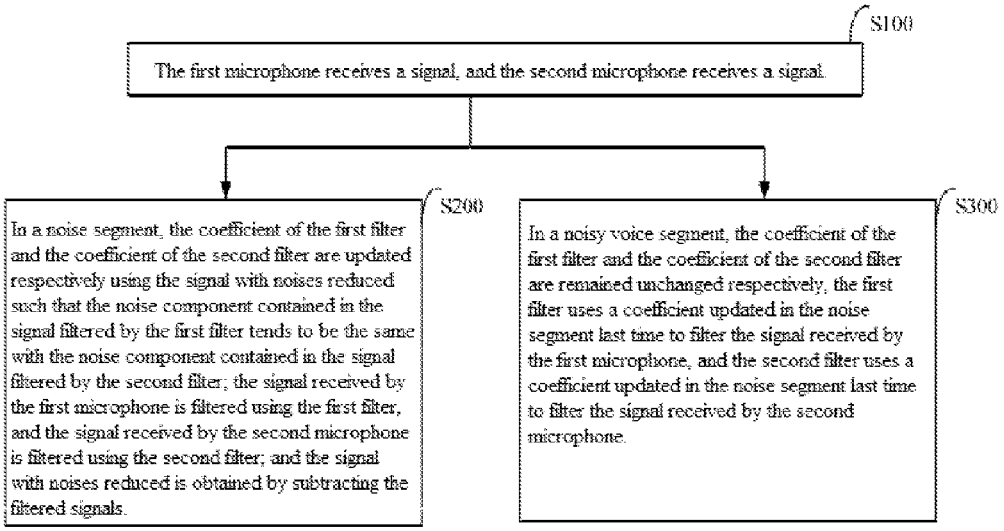
FIG. 4 is a flowchart of a method for self-adaptively eliminating noises in an embodiment of the present invention.

FIG. 4 is a flowchart of a method for self-adaptively eliminating noises in the embodiment of the present invention. The method comprises the following steps:

Step S100: a first microphone receives a signal, and a second microphone receives a signal;

Step S200: in a noise segment, the coefficient of the first filter and the coefficient of the second filter are updated respectively using the signal with noises reduced such that the noise component contained in the signal filtered by the first filter tends to be the same with the noise component contained in the signal filtered by the second filter; the signal received by the first microphone is filtered using the first filter, and the signal received by the second microphone is filtered using the second filter; and the signal with noises reduced is obtained by subtracting the filtered signals;

Step S300: in a noisy voice segment, the coefficient of the first filter and the coefficient of the second filter are remained unchanged respectively; the first filter uses a coefficient updated in the noise segment last time to filter the signal received by the first microphone; and the second filter uses a coefficient updated in the noise segment last time to filter the signal received by the second microphone.

Embodiment 2

In Embodiment 2, the process of updating the filter is described as below:

in a noise segment, updating the coefficient of the first filter and the coefficient of the second filter specifically comprises: in a noise segment, updating the coefficient of the first filter and the coefficient of the second filter in the following manner:

approaching the ratio of the transfer function of the first filter to the transfer function of the second filter to the ratio of the channel transfer function between a noise source and the second microphone to the channel transfer function between the noise source and the first microphone.

Figure 5:
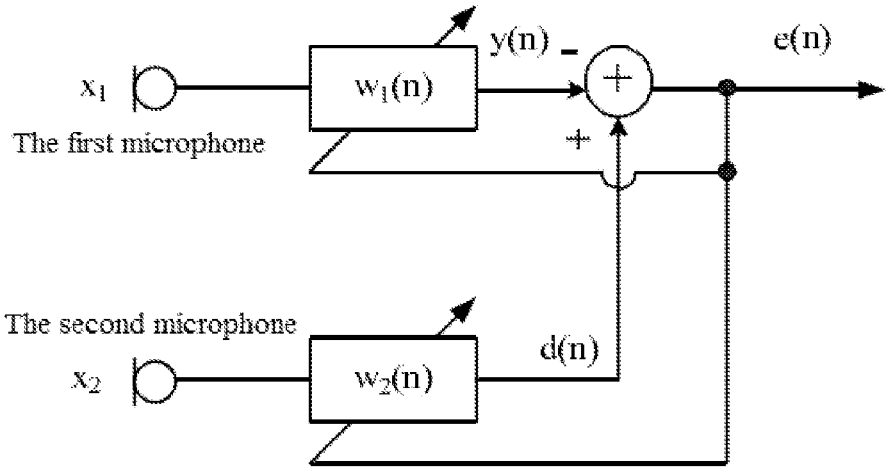
FIG. 5 is a principle diagram of a method for self-adaptively eliminating noises in an embodiment of the present invention.
Figure 6:
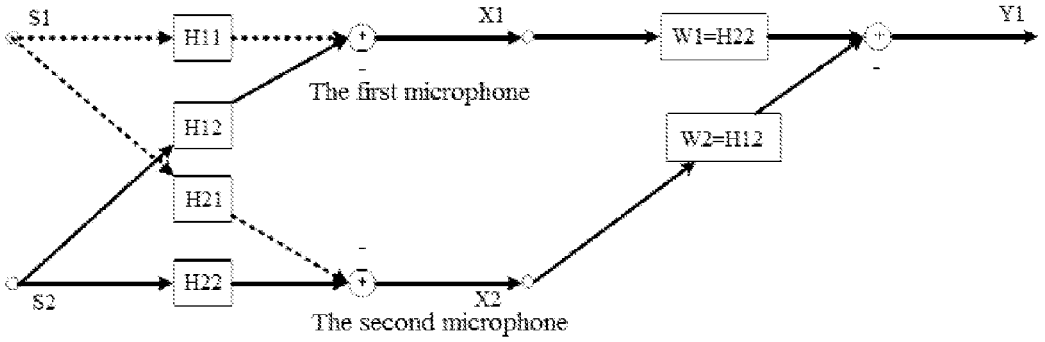
FIG. 6 is a schematic diagram analyzing the principle of a method for self-adaptively eliminating noises in an embodiment of the present invention.

In the following, the principle of the method for self-adaptively eliminating noises in this embodiment is described. FIG. 5 is a principle diagram of a method for self-adaptively eliminating noises in the embodiment of the present invention. FIG. 6 is a schematic diagram analyzing the principle of a method for self-adaptively eliminating noises in the embodiment of the present invention.

Referring to FIG. 6, S1 represents a signal source, S2 represents a noise source, X1 is a frequency domain value of the signal received by the first microphone, X2 is a frequency domain value of the signal received by the second microphone, W1 and W2 are transfer functions of the first filter and the second filter respectively, and Y1 is a frequency domain value of the signal with noises reduced.

The following equations can be obtained:

$$X1 = S1 \times H11 + S2 \times H12 \quad \text{Equation 6}$$

$$X2 = S1 \times H21 + S2 \times H22 \quad \text{Equation 7}$$

$$\begin{aligned} Y1 &= X1 \times W1 - X2 \times W2 \\ &= (S1 \times H11 + S2 \times H12) \times W1 - (S1 \times H21 + S2 \times H22) \times W2 \\ &= S1 \times (H11 \times W1 - H21 \times W2) + S2 \times (H12 \times W1 - H22 \times W2) \end{aligned} \quad \text{Equation 8}$$

Since noise source S2 will be completely eliminated when W is taken as the optimal solution, there is a relationship between the two filters, W1 and W2, as indicated by Equation 9.

$$\frac{W1}{W2} = \frac{H22}{H12} \quad \text{Equation 9}$$

When the relationship between the transfer functions of the two filters satisfies Equation 9, the signal with noises reduced is:

$$Y1 = S1 \times (H11 \times W1 - H21 \times W2) = S1 \times (H11 \times H22 - H21 \times H12) \times \frac{W1}{H22} \quad \text{Equation 10}$$

Y1 is a form of S1 that has been filtered in a certain mode. Upon the above analysis, it can be known that Y1 does not contain any component of S2.

In this embodiment, the ratio of the transfer function of the first filter to the transfer function of the second filter approaches the ratio of the channel transfer function between the noise source and the second microphone to the channel transfer function between the noise source and the first microphone in many ways.

For example, the transfer function of the first filter approaches the channel transfer function between the noise source and the second microphone, and the transfer function of the second filter approaches the channel transfer function between the noise source and the first microphone.

FIG. 6 is a schematic diagram analyzing the principle of a method for self-adaptively eliminating noises in this example.

The transfer function of the first filter is W1, W1=H22. The transfer function of the second filter is W2, W2=H12. In this case, the noise components in the signals filtered by the two filters are the same. Thus, in this example, by approaching W1 to H22 and W2 to H12, it can be ensured that the noise components in the signals filtered by the two filters are as similar as possible, so as to effectively eliminate noises.

For another example, the transfer function of the first filter approaches the product of the channel transfer function between the noise source and the second microphone and a constant, and the transfer function of the second filter approaches the product of the channel transfer function between the noise source and the first microphone and the constant. The constant may be a constant number or a transfer function. That is, W1=H22·H, W2=H12·H, where H is a transfer function or a constant number.

In this example, it is also ensured that the noise components contained in the signals filtered by the first filter and the second filter are as similar as possible so as to effectively eliminate noises.

Therein, the coefficient of the filter (the first filter or the second filter) is updated by means of least mean square algorithm or fast block least mean square algorithm such that the filter approaches a corresponding transfer function.

Since the noises in the signal can be eliminated when the relationship between the transfer functions of the two filters satisfies Equation 9, the error introduced will be significantly reduced and the noise reduction effect will be greatly enhanced if two FIR filters are used to make their interrelationship approach Equation 9.

In this manner, if every time the filter coefficient latest updated in the noise segment last time is used for filtering, the noise components in the signals filtered by the two filters will tend to be the same, and they will offset each other. Therefore, the noise component in the signal with noises reduced will be reduced constantly and the quality of the output voice will be constantly improved.

Embodiment 3

Figure 7:
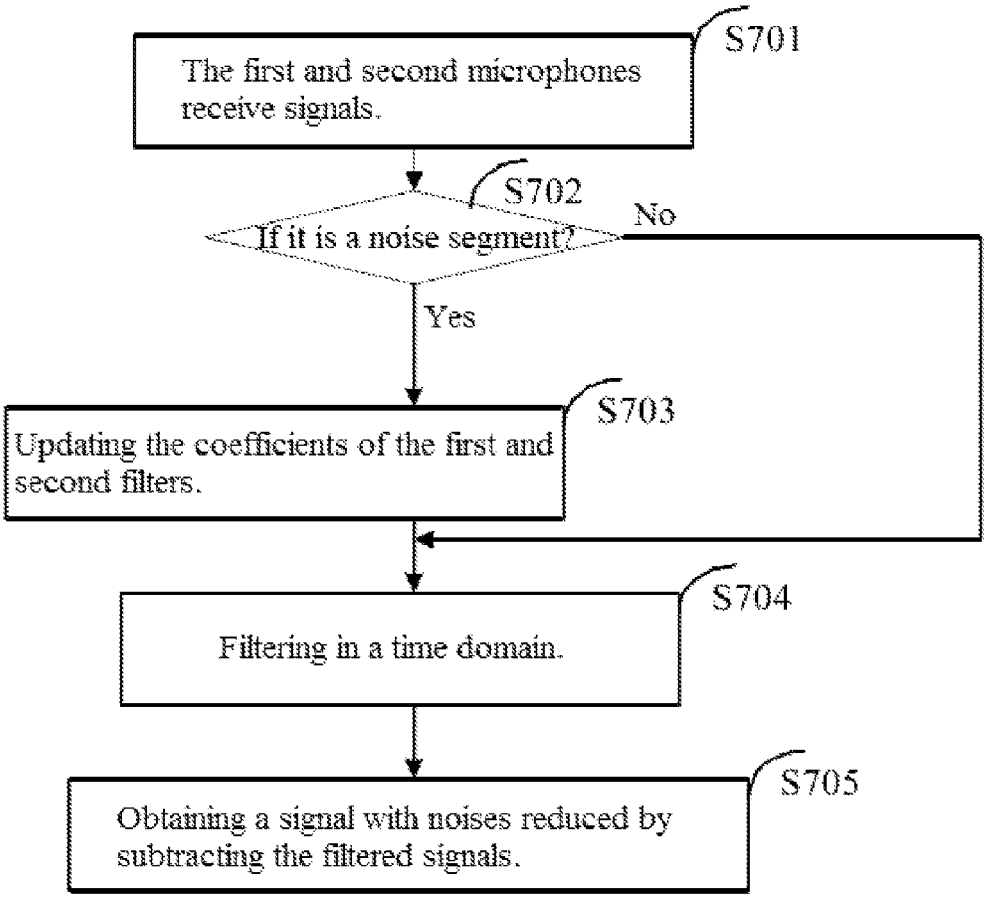
FIG. 7 is a time domain processing flowchart of a method for self-adaptively eliminating noises in an embodiment of the present invention.
Figure 8:
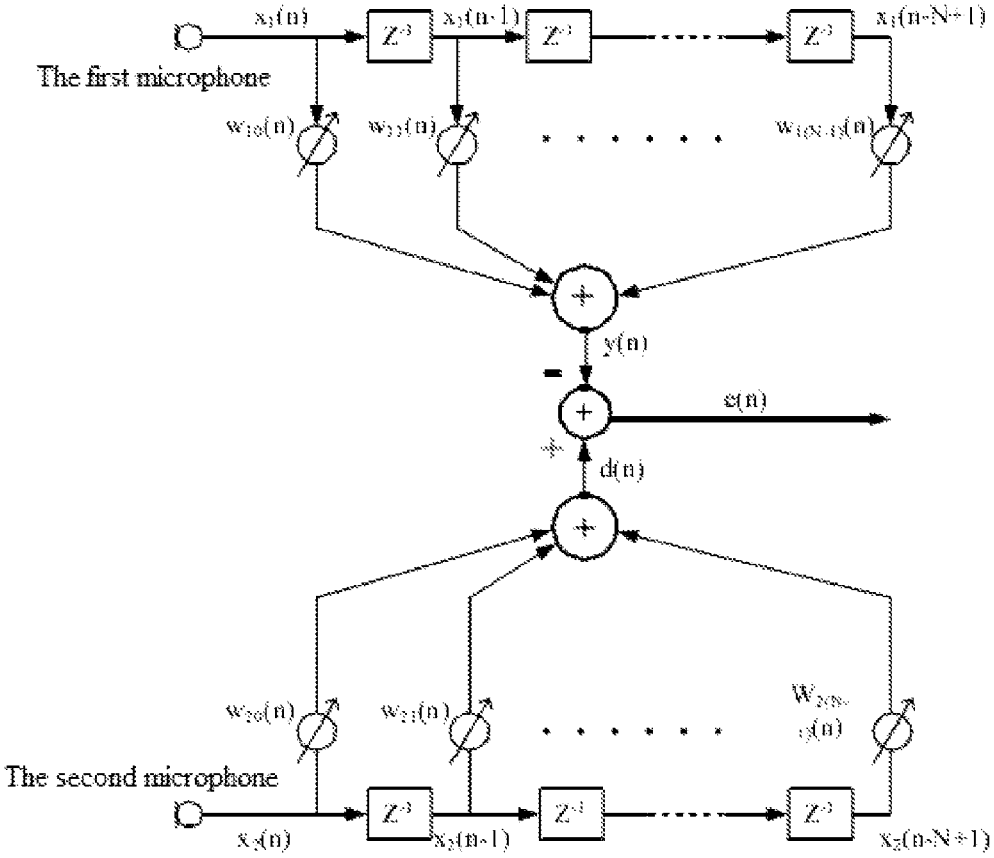
FIG. 8 is a schematic diagram of a method for self-adaptively eliminating noises in an embodiment of the present invention.

In this embodiment, the coefficient of filters is updated using time domain LMS algorithm. The time domain processing flowchart of a method for self-adaptively eliminating noises in the embodiment of the present invention is as shown in FIG. 7. The schematic diagram of the method for self-adaptively eliminating noises in this embodiment is as shown in FIG. 8, wherein a dual-filter is used to eliminate noises.

Step S701, the first microphone and the second microphone respectively receive a signal.

Step S702, whether the signal is a noise segment or not is determined, if it is, step S703 is performed; otherwise, step S704 is performed.

If the signal is a signal of a noisy voice segment, the coefficient of the filters will not be updated and the filters use a coefficient updated in the noise segment last time.

Step S703, the coefficients of the first and second filters are updated.

Step S704, the signals are filtered in a time domain using the filters.

Step S705, the signals filtered by the two filters are subtracted, and a signal with noised reduced is output.

The process of updating the coefficients of the first and second filters in Step S703 is described in detail in below according to the schematic diagram of FIG. 8.

The filter coefficient in a dual-filter structure is updated using time domain LMS algorithm. The signal filtered by the first filter is y(n), which, as shown in Equation 11, is a noisy signal of the input signal filtered by the first filter. The signal filtered by the second filter is d(n), which, as shown in Equation 12, is a noisy signal of the input signal filtered by the second filter. The signal output after subtracting the signals filtered by the two filters is e(n), which is as shown in Equation 13.

$$y(n) = \sum_{i=0}^{N-1} w_{1i}(n)x_1(n-i) \quad \text{Equation 11}$$

$$d(n) = \sum_{j=0}^{N-1} w_{2j}(n)x_2(n-j) \quad \text{Equation 12}$$

$$e(n) = d(n) - y(n) \quad \text{Equation 13}$$

The transfer function of the filters is updated using LMS algorithm. The transfer function of the first filter is updated according to Equation 14, and the transfer function of the second filter is updated according to Equation 15.

$$W_1(n+1) = W_1(n) - \mu\left[\frac{\partial e^2(n)}{\partial w_{10}} \; \frac{\partial e^2(n)}{\partial w_{11}} \; \cdots \; \frac{\partial e^2(n)}{\partial w_{1(N-1)}}\right]^T = W_1(n) + 2\mu e(n)X_1(n) \quad \text{Equation 14}$$

$$W_2(n+1) = W_2(n) - \mu\left[\frac{\partial e^2(n)}{\partial w_{20}} \; \frac{\partial e^2(n)}{\partial w_{21}} \; \cdots \; \frac{\partial e^2(n)}{\partial w_{2(N-1)}}\right]^T = W_2(n) + 2\mu e(n)X_2(n) \quad \text{Equation 15}$$

where $W_1(n)$, $W_2(n)$, $X_1(n)$ and $X_2(n)$ all indicate a column vector, and superscript T indicates transpose, and $$X_1(n)=[x_1(n)x_1(n-1) \ldots x_1(n-N+1)]^T$$

$$X_2(n)=[x_2(n)x_2(n-1) \ldots x_2(n-N+1)]^T$$

where e(n) is a signal with noises reduced, d(n) is a signal filtered by the first filter, y(n) is a signal filtered by the second filter, $W_1(n)$ is a transfer function of the first filter, $W_2(n)$ is a transfer function of the second filter, μ is a step size factor, $X_1(n)$ is a signal vector received by the first microphone, $X_2(n)$ is a signal vector received by the second microphone, and N is the order of the filter.

Embodiment 4

Figure 9:
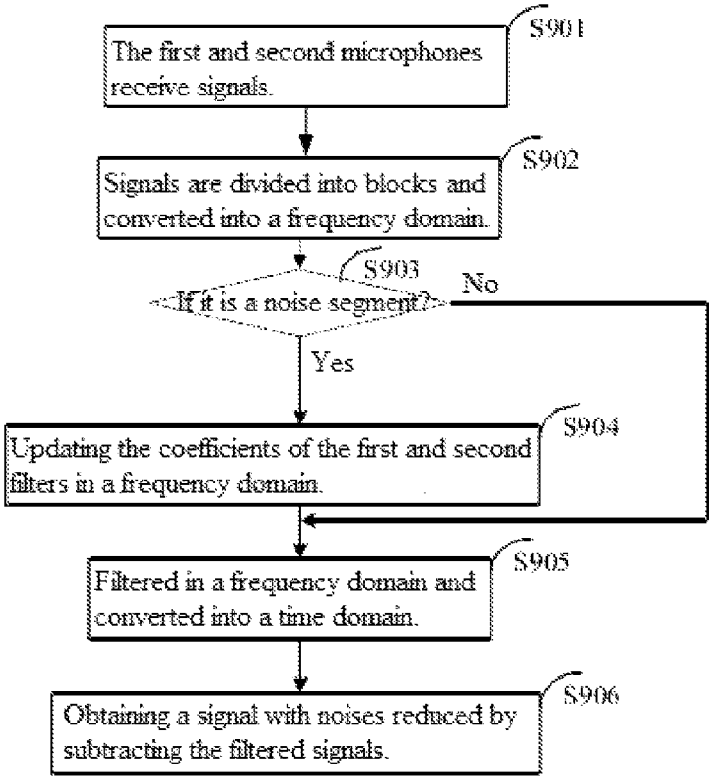
FIG. 9 is a frequency domain processing flowchart of a method for self-adaptively eliminating noises in an embodiment of the present invention.

In this embodiment, the coefficient of filters is updated using FBLMS algorithm by combining time and frequency domains. The frequency domain processing flowchart of a method for self-adaptively eliminating noises in this embodiment is as shown in FIG. 9.

Step S901, the first microphone and the second microphone respectively receive a signal.

Step S902, the signals received by the first microphone and the second microphone are divided into blocks and converted into a frequency domain.

Step S903, whether the signal is a noise segment or not is determined, if it is, step S904 is performed; otherwise, step S905 is performed.

If the signal is a signal of a noisy voice segment, the coefficients of the filters will not be updated and the filters use coefficients updated in the noise segment last time.

Step S904, the coefficients of the first and second filters are updated in a frequency domain.

Step S905, the signals are filtered in the frequency domain, and the filtered signals are converted into a time domain.

Step S906, the signals filtered by the two filters are subtracted, and a signal with noised reduced is output.

Referring to the principle diagram of FIG. 5, the process of updating coefficients of the first and second filters in step S904 is described in detail.

In the following is given an equation for updating a filter by means of FBLMS algorithm using a dual-filter structure, where "*" represents convolution, wherein, the signal filtered by the first filter is y(n), which, as shown in Equation 16, is a noisy signal of the input signal filtered by the first filter. The signal filtered by the second filter is d(n), which, as shown in Equation 17, is a noisy signal of the input signal filtered by the second filter. The signal output after subtracting the signals filtered by the two filters is e(n), which is as shown in Equation 18.

$$y(n)=w_1(n)*x_1(n) \quad \text{Equation 16}$$

$$d(n)=w_2(n)*x_2(n) \quad \text{Equation 17}$$

$$e(n)=d(n)-y(n) \quad \text{Equation 18}$$

Equation 18 is converted by means of FFT (Fast Fourier Transform) into a frequency domain as shown in Equation 19.

$$E(k)=D(k)-Y(k)=W_2(k)\cdot X_2(k)-W_1(k)\cdot X_1(k) \quad \text{Equation 19}$$

The principle of using FBLMS algorithm is as the following equations:

$$\nabla W_1(k) \propto \frac{\partial [E(k)]^2}{\partial W_1(k)} = 2\cdot E(k)\cdot \frac{\partial [E(k)]}{\partial W_1(k)} = -2E(k)\cdot \overline{X_1(k)} \quad \text{Equation 20}$$

$$\nabla W_2(k) \propto \frac{\partial [E(k)]^2}{\partial W_2(k)} = 2\cdot E(k)\cdot \frac{\partial [E(k)]}{\partial W_2(k)} = 2E(k)\cdot \overline{X_2(k)} \quad \text{Equation 21}$$

$$W_1(k+1) = W_1(k) - \mu\cdot\nabla W_1(k) = W_1(k) + 2\cdot\mu\cdot E(k)\cdot \overline{X_1(k)} \quad \text{Equation 22}$$

$$W_2(k+1) = W_2(k) - \mu\cdot\nabla W_2(k) = W_2(k) - 2\cdot\mu\cdot E(k)\cdot \overline{X_2(k)} \quad \text{Equation 23}$$

where e(n) represents a signal with noises reduced, E(k) is a frequency domain indication of e(n), d(n) represents a signal filtered by the first filter, D(k) is a frequency domain indication of d(n), y(n) represents a signal filtered by the second filter, Y(k) is a frequency domain indication of y(n), $X_1(k)$ is a frequency domain indication of the signal received by the first microphone, $X_2(k)$ is a frequency domain indication of the signal received by the second microphone, $W_1$ and $W_2$ represent a frequency domain indication of the transfer function of a self-adaptive filter, μ represents a step size factor, $\overline{X_1(k)}$ represents a conjugate of $X_1(k)$, and $\overline{X_2(k)}$ represents a conjugate of $X_2(k)$.

Based on Equation 22 and Equation 23, the filter coefficients are updated using FBLMS algorithm.

1. Filtering

Let two frequency domain filters with length of N be $w_{F1}(k)$ and $w_{F1}(k)$, N zeros are filled both before and after the signals received by the first microphone and the second microphone, and then the signals are divided into blocks to obtain block signals $\tilde{x}_1(k)$ and $\tilde{x}_2(k)$ with length of L+N−1, wherein N data overlap between the blocks.

$$x_{F1}(k)=FFT(\tilde{x}_1(k)) \quad \text{Equation 24}$$

$$x_{F2}(k)=FFT(\tilde{x}_2(k)) \quad \text{Equation 25}$$

$$y(k)=IFFT(x_{F1}(k)\otimes w_{F1}(k)) \quad \text{Equation 26}$$

$$d(k)=IFFT(x_{F2}(k)\otimes w_{F2}(k)) \quad \text{Equation 26}$$

where k=1: L+N−1 represents 1 to L+N−1, "$\otimes$" represents point multiplication, IFFT represents Inverse Fast Fourier Transform, and the signal of subscript "F" represents a frequency domain signal.

2. Error Estimation $$e(m)=d(N:L+N-1)-y(N:L+N-1) \quad \text{Equation 28}$$

where m=1:L represents 1 to L; d(N:L+N−1) are the last L elements of d(k) in Equation 27, which are corresponding to d(n) in FIG. 5; y(N:L+N−1) are the last L elements of y(k) in Equation 26, which are corresponding to y(n) in FIG. 5; and e(m) is a signal with noises reduced.

3. Filter Updating $$e_F(k) = FFT\left(\begin{bmatrix} \text{supplement } N-1 \text{ zeros} \\ e(m) \end{bmatrix}\right) \quad \text{Equation 29}$$

$$w_{F1}(k+1) = w_{F1}(k) + 2\mu \otimes \overline{x_{F1}(k)} \otimes e_F(k) \quad \text{Equation 30}$$

$$w_{F2}(k+1) = w_{F2}(k) - 2\mu \otimes \overline{x_{F2}(k)} \otimes e_F(k) \quad \text{Equation 31}$$

4. Filter Constraint $$w_{F1}(k+1)=FFT([\text{supplement } L-1 \text{ zeros in the first } N \text{ data of } IFFT(w_{F1}(k+1))]) \quad \text{Equation 32}$$

$$w_{F2}(k+1)=FFT([\text{supplement } L-1 \text{ zeros in the first } N \text{ data of } IFFT(w_{F2}(k+1))]) \quad \text{Equation 33}$$

The filter transfer functions in Equation 30 and Equation 31 contain redundant data errors. By means of Equation 32 and Equation 33, zeros are filled after eliminating the redundant data errors from the transfer functions.

Figure 10:
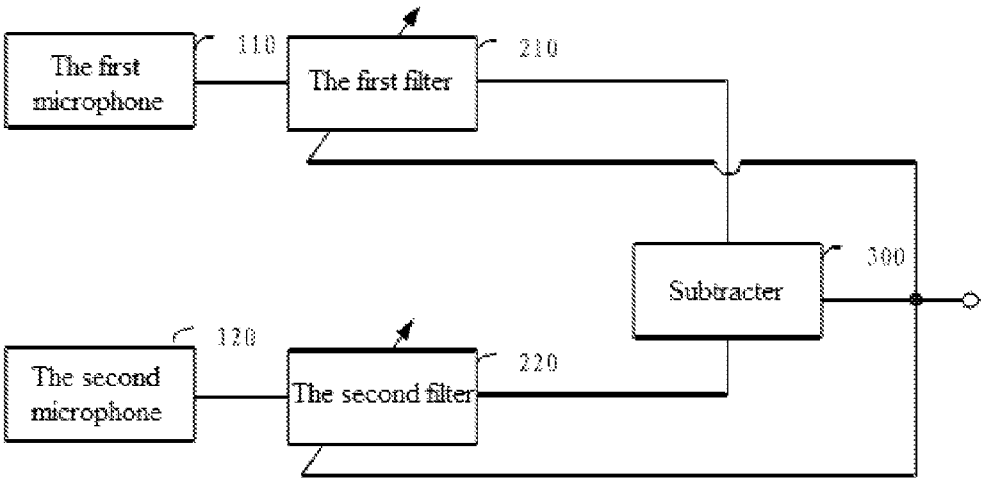
FIG. 10 is a structural diagram of a device for self-adaptively eliminating noises in an embodiment of the present invention.

FIG. 10 is a structural diagram of a device for self-adaptively eliminating noises in the embodiment of the present invention.

The device comprises: a first microphone 110, a second microphone 120, a first filter 210, a second filter 220, and a subtracter 300;

the first microphone 110 inputs the received signal to the first filter 210, and the first filter 210 inputs the filtered signal to the subtracter 300;

the second microphone 120 inputs the received signal to the second filter 220, and the second filter 220 inputs the filtered signal to the subtracter 300;

the subtracter 300 subtracts the signals filtered by the first filter 210 and the second filter 220 to obtain a signal with noises reduced;

wherein, in a noise segment, the coefficient of the first filter 210 and the coefficient of the second filter 220 are updated respectively based on the signal with noises reduced such that the noise component contained in the signal filtered by the first filter 210 tends to be the same with the noise component contained in the signal filtered by the second filter 220;

and, in a noisy voice segment, the coefficient of the first filter 210 and the coefficient of the second filter 220 are remained unchanged respectively, the coefficient used by the first filter 210 for filtering the signal received by the first microphone 110 is a coefficient updated in the noise segment last time, and the coefficient used by the second filter 220 for filtering the signal received by the second microphone 120 is a coefficient updated in the noise segment last time.

Further, the ratio of the transfer function of the first filter 210 to the transfer function of the second filter 220 approaches the ratio of the channel transfer function between a noise source and the second microphone 120 to the channel transfer function between the noise source and the first microphone 110.

Further, the transfer function of the first filter 210 approaches the channel transfer function between the noise source and the second microphone 120, and the transfer function of the second filter 220 approaches the channel transfer function between the noise source and the first microphone 110.

Further, the transfer function of the first filter 210 approaches the product of the channel transfer function between the noise source and the second microphone 120 and a constant, and the transfer function of the second filter 220 approaches the product of the channel transfer function between the noise source and the first microphone 110 and the constant.

Furthermore, the coefficient of the first filter 210 is updated by means of least mean square algorithm or fast block least mean square algorithm according to the signal with noises reduced; and the coefficient of the second filter 220 is updated by means of least mean square algorithm or fast block least mean square algorithm according to the signal with noises reduced.

The foregoing is only preferred embodiments of the present invention, and they are not used for limiting the protection scope of the present invention. Any modification, equivalent replacement and improvement within the spirit and principles of the present invention should be included in the protection scope of the present invention.

The invention claimed is:

1. A method for self-adaptively eliminating noises, the method comprising:

determining whether a first signal received by a first microphone and a second signal received by a second microphone are in a noise segment or a noisy voice segment;

if in the noise segment, (a) updating a coefficient of a first filter and a coefficient of a second filter respectively using a noises reduced signal; (b) filtering the first signal by the first filter using an updated coefficient, filtering the second signal by the second filter using an updated coefficient, and (c) obtaining a noises reduced signal with noises reduced by subtracting the filtered signals;

wherein, in the noise segment, updating includes updating the coefficient of the first filter and the coefficient of the second filter using the noises reduced signal in the following manner: the ratio of the transfer function of the first filter to the transfer function of the second filter approaches the ratio of the channel transfer function between a noise source and the second microphone to the channel transfer function between the noise source and the first microphone; and if in the noisy voice segment, (a) remaining the coefficient of the first filter and the coefficient of the second filter unchanged, (b) filtering the first signal by the first filter using a coefficient updated in the noise segment last time, and (c) filtering the second signal by the second filter using a coefficient updated in the noise segment last time, and obtaining a noise reduced signal by subtracting the filtered signals.

2. The method according to claim 1, wherein:

approaching the ratio of the transfer function of the first filter to the transfer function of the second filter to the ratio of the channel transfer function between a noise source and the second microphone to the channel transfer function between the noise source and the first microphone further comprises:

approaching the transfer function of the first filter to the channel transfer function between the noise source and the second microphone, and approaching the transfer function of the second filter to the channel transfer function between the noise source and the first microphone.

3. The method according to claim 1, wherein:

approaching the ratio of the transfer function of the first filter to the transfer function of the second filter to the ratio of the channel transfer function between a noise source and the second microphone to the channel transfer function between the noise source and the first microphone further comprises:

approaching the transfer function of the first filter to the product of the channel transfer function between the noise source and the second microphone and a constant, and approaching the transfer function of the second filter to the product of the channel transfer function between the noise source and the first microphone and the constant.

4. The method according to claim 1, wherein:

updating the coefficient of the first filter and the coefficient of the second filter respectively using the noises reduced signal specifically comprises:

updating the coefficient of the first filter and the coefficient of the second filter respectively using the noises reduced signal by least mean square algorithm or fast block least mean square algorithm.

5. A device for self-adaptively eliminating noises, the device comprising:

a first microphone, a second microphone, a first filter, a second filter, and a subtracter;

wherein the first microphone is configured to input a first received signal to the first filter, the first filter is configured to filter the first received signal and transmit the first filtered signal to the subtracter;

wherein the second microphone is configured to input a second received signal to the second filter, the second filter is configured to filter the second received signal and transmit the second filtered signal to the subtracter;

wherein the subtracter is configured to subtract the first filtered signal and the second filtered signal to obtain a noises reduced;

wherein the device is configured to:

when the first received signal and the second received signal are determined as in a noise segment, (a) update a coefficient of the first filter and a coefficient of the second filter using the noises reduced signal, (b) filter the first received signal by the first filter using a first updated coefficient to filter, filter the second received signal by the second filter using a second updated coefficient, wherein, in the noise segment, the coefficient of the first filter and the coefficient of the second filter are updated respectively based on the noises reduced signal in the following manner: the ratio of the transfer function of the first filter to the transfer function of the second filter approaches the ratio of the channel transfer function between a noise source and the second microphone to the channel transfer function between the noise source and the first microphone; and when the first received signal and the second received signal are determined as in a noisy voice segment, (a) remain the coefficient of the first filter and the coefficient of the second filter unchanged, (b) filter the first received signal by the first filter using the coefficient updated in the noise segment last time, and filtering the second received signal by the second filter using the coefficient updated in the noise segment last time.

6. The device according to claim 5, wherein:

the transfer function of the first filter approaches the channel transfer function between a noise source and the second microphone, and the transfer function of the second filter approaches the channel transfer function between the noise source and the first microphone.

7. The device according to claim 5, wherein:

the transfer function of the first filter approaches the product of the channel transfer function between the noise source and the second microphone and a constant, and the transfer function of the second filter approaches the product of the channel transfer function between the noise source and the first microphone and the constant.

8. The device according to claim 5, wherein:

the coefficient of the first filter is updated by least mean square algorithm or fast block least mean square algorithm according to the noises reduced signal; and the coefficient of the second filter is updated by least mean square algorithm or fast block least mean square algorithm according to the noises reduced signal.

* * * * *